US010190336B2

(12) United States Patent
Promutico et al.

(10) Patent No.: US 10,190,336 B2
(45) Date of Patent: Jan. 29, 2019

(54) MAGNETICALLY ACTIVATED DOOR-LOCK DEVICE

(71) Applicant: BITRON S.p.A., Turin (IT)

(72) Inventors: Fabrizio Promutico, Turin (IT); Felice Paglia, Turin (IT)

(73) Assignee: BITRON S.P.A., Turin (IT)

( * ) Notice: Subject to any disclaimer, the term of this patent is extended or adjusted under 35 U.S.C. 154(b) by 808 days.

(21) Appl. No.: 14/760,249

(22) PCT Filed: Jan. 9, 2014

(86) PCT No.: PCT/IT2014/000006
§ 371 (c)(1),
(2) Date: Jul. 10, 2015

(87) PCT Pub. No.: WO2014/108928
PCT Pub. Date: Jul. 17, 2014

(65) Prior Publication Data

US 2015/0354248 A1 Dec. 10, 2015

(30) Foreign Application Priority Data

Jan. 10, 2013 (IT) ..... RM2013A0017

(51) Int. Cl.
*E05B 47/02* (2006.01)
*D06F 37/42* (2006.01)

(52) U.S. Cl.
CPC ..... *E05B 47/026* (2013.01); *D06F 37/42* (2013.01); *Y10T 292/1014* (2015.04)

(58) Field of Classification Search
CPC ..... Y10T 292/11
See application file for complete search history.

(56) References Cited

U.S. PATENT DOCUMENTS 3,892,933 A 7/1975 Rocchitelli
7,408,433 B1 * 8/2008 Irwin ..... E05B 47/0002 335/228

(Continued)

FOREIGN PATENT DOCUMENTS

EP 1 621 658 A2 2/2006
EP 2 450 510 A2 5/2012

(Continued)

OTHER PUBLICATIONS

International Search Report dated May 28, 2014 from corresponding International Patent Application No. PCT/IT2014/000006; 4 pgs.

(Continued)

*Primary Examiner* — Alyson M Merlino
(74) *Attorney, Agent, or Firm* — Maier & Maier, PLLC

(57) ABSTRACT

The present invention concerns a door-lock device for a household appliance, said door-lock device comprising a mechanical unit, provided with a movable member, such as a slider and the like, capable of assuming a releasing position, in which it allows the opening of said door, and a locking position, for retaining said door when closed, and a control unit connected with the control logic of said household appliance, comprising a locking pin capable of assuming at least one position, in which it is disengaged from said movable member, and an extracted position, in which said locking pin is capable of engaging with said movable member, when the latter is in said locking position, said movable member being capable to pass from said locking position to said releasing position when said locking pin is disengaged from it.

7 Claims, 4 Drawing Sheets

(56) References Cited

U.S. PATENT DOCUMENTS

| | | | | |
|---|---|---|---|---|
| 7,532,098 | B2 * | 5/2009 | Spurr | E05B 81/14 335/229 |
| 8,830,017 | B2 * | 9/2014 | Yang | H01H 51/2272 335/78 |
| 2008/0106105 | A1 * | 5/2008 | Spiessl | D06F 37/42 292/210 |

FOREIGN PATENT DOCUMENTS

| | | | |
|---|---|---|---|
| WO | 2005/106099 | A1 | 11/2005 |
| WO | 2009/004447 | A1 | 1/2009 |
| WO | 2010/026536 | A1 | 3/2010 |

OTHER PUBLICATIONS

Italian Search Report dated Oct. 23, 2013 from corresponding Italian Application No. ITRM20130017; 7 pgs.

* cited by examiner 1
22
25
23
51
20
21

1
22
33
50
32
30
60
51
45
33
40
23

41
21
521
522
31
53
532
523
32
30
1
A
52
40
45
+
−
C
51
523
532

53
41
533
531

Sez. A-A

Sez. B-B

MAGNETICALLY ACTIVATED DOOR-LOCK DEVICE

This application is based upon and claims the benefit of priority from the prior Italian Patent Application No. RM2013A000017, filed on Jan. 10, 2013, and International Patent Application No. PCT/IT2014/000006, filed on Jan. 9, 2014, the entire contents of which are incorporated herein by reference.

BACKGROUND

As it is well known there are currently several models of door-lock devices in the market used in different types of household appliances, for example washing machines, capable to prevent door opening, until the operation cycle of the household appliance is not ended.

In general, said door-lock devices comprise, a mechanical unit, provided with a movable slider or a similar mechanical member, capable of interacting with the hook of the door when it is closed, and a second slot or groove. The mechanical unit interacts with a control unit, in its turn connected with the control logic of the washing machine. Said control unit is adapted to drive a locking pin capable of assuming an operating position, in which it is extracted from a seat and it is engaged in said second slot of said slider, or in general to interact with the mechanical unit, and a resting position, in which it is retracted in said seat.

When the washing machine or the household appliance is not active, the door is closed and the hook is inserted in said opening, said hook interacts with said first slot of said slider, which translates, so as to allow the locking pin to engage with said second slot and retaining said hook blocked.

To open the door it is necessary to act on the electronics of the washing machine for extracting the locking pin from said second slot and releasing the slider. In this way, by opening the door, the hook of the door can disengage from the slider or from any other possible mechanical members.

The control units according to the prior art, which, as mentioned above, are electromechanical devices, have the technical problem of presenting non-negligible dimensions, as well as a high complexity, as they usually comprise a large number of elements, which generate complications in the assembly of the final product, with consequent economic disadvantages.

SUMMARY

In light of the above, it is, therefore, object of the present invention to propose a magnetically activated control unit for a door-lock device, capable of overcoming the technical problems and the drawbacks of those of the prior art.

It is therefore a specific object of the present invention door-lock device for a household appliance, such as a washing machine and the like, said door-lock device comprising a mechanical unit, provided with a movable member, such as a slider and the like, capable of assuming a releasing position, in which it allows the opening of said door, and a locking position, for retaining said door when closed, and a control unit connected with the control logic of said household appliance, comprising a locking pin capable of assuming at least one position, in which it is disengaged from said movable member, and an extracted position, in which said locking pin is capable of engaging with said movable member, when the latter is in said locking position, said movable member being capable to pass from said locking position to said releasing position when said locking pin is disengaged from it, characterized in that said control unit further comprises an electromagnet having a solenoid electrically powered, in order to change its polarity, said electromagnet being provided with an air gap, a switching assembly comprising a magnet, said switching assembly being arranged in said air gap, and being capable to assume a first and a second position, according to the polarity of the magnetic field in said air gap, generated from the power supply of said solenoid, and an activation switch, for controlling the power supply of a load, and in that said locking pin is kinematically constrained to said switching assembly, so that when said switching assembly is in said first position, said locking pin is disengaged from said movable member of said mechanical unit, while, when said switching assembly is in said second position, said locking pin is in said extracted position, causing the closure of said activation switch.

Always according to the invention, said switching assembly could comprise a container, laterally provided with a relief, and said locking pin has a guide, substantially "S"-shaped, in which said relief of said container is slidingly inserted, so that the rotation of said switching assembly causes the translation of said locking pin.

Still according to the invention, said switching assembly could comprise two plates, parallel arranged to each other, and a permanent magnet, interposed between said two plates, said plates and said magnet being located in said container.

Further according to the invention, said control unit could comprise a containment enclosure and said switching assembly could be pivoted to said containment enclosure.

Advantageously according to the invention, said activating switch could comprise a lamina having two ends, on each of which a movable electrode is fixed, each movable electrode having a respective fixed electrode, and said locking pin has a seat, in which said lamina is inserted.

Always according to the invention, said control unit could comprise a safety switch series connected with said solenoid, arranged so as to remain opened when said door is opened.

Still according to the invention, said safety switch could comprise a fixed electrode, a movable electrode and a lamellar spring, on which said movable electrode is arranged, said lamellar spring being arranged in correspondence with said locking pin, and said guide could have a width greater than said relief, so as to create a plat, so that: when said door is opened, said movable member is in said releasing position and said locking pin assumes a retracted position, in which it is retained by said movable member, and in which it maintains open said safety switch; when said door is closed, said movable member is in said locking position, in which it releases said locking pin, said locking pin translates of a path equal to said play, so that said switch closes, due to the force exerted by said lamellar spring on said locking pin; and when said door is closed and said switching assembly switches from said first to said second position, said locking pin is in said extracted position, engaging with said movable member.

Further according to the invention, said electromagnet could comprise a core on which said solenoid is wound, made up of a couple of armatures, which form said air gap.

BRIEF DESCRIPTION OF THE FIGURES

The present invention will be now described, for illustrative but not limitative purposes, according to its preferred embodiments, with particular reference to the figures of the enclosed drawings, wherein.

In the various figures, similar parts will be indicated by the same reference numbers.

DETAILED DESCRIPTION

Figures 1, 2, 3:
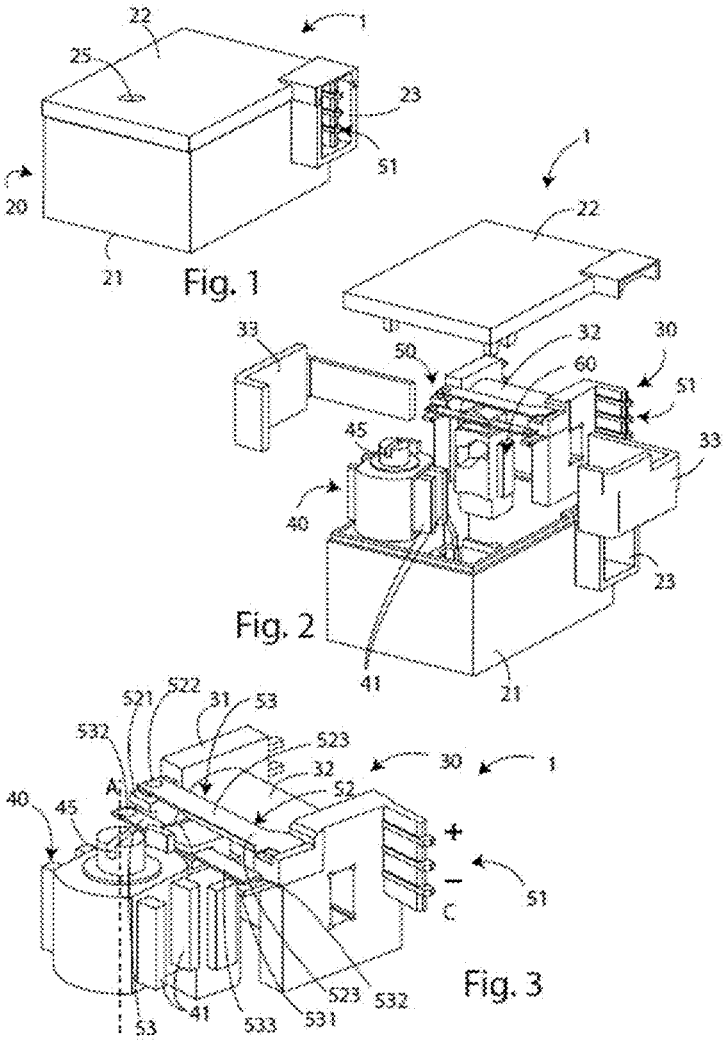
FIG. 1 shows a perspective view of a control unit of a door-lock device according to the present invention.
FIG. 2 shows an exploded view of the control unit according to FIG. 1.
FIG. 3 shows an internal view of the control unit according to the present invention.
Figure 4:
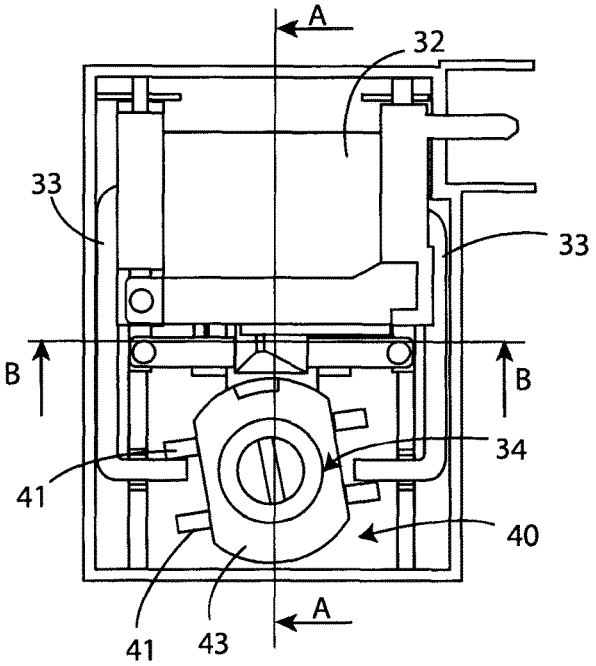
FIG. 4 shows the plan view of the internal part of the control unit according to FIG. 1.
Figure 5:
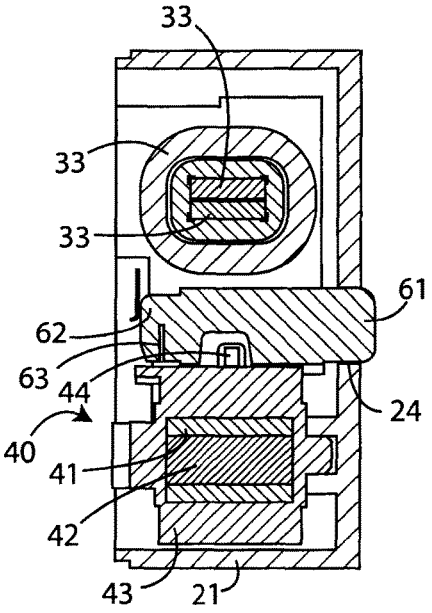
FIG. 5 shows a sectional view taken along line AA of the control unit according to FIG. 4.
Figure 6:
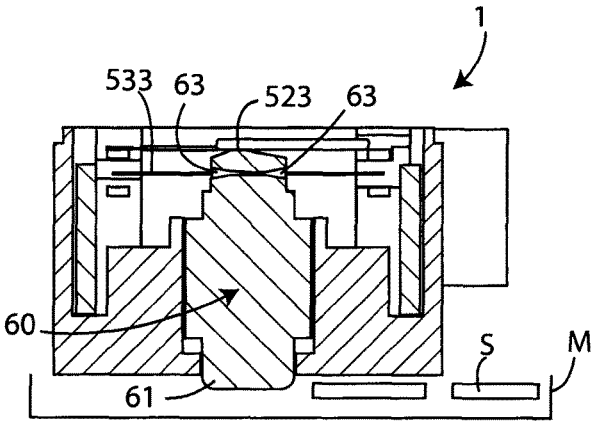
FIG. 6 shows a sectional view taken along line BB of the control unit according to FIG. 4.

The present invention relates to a magnetically activated door-lock device.

More specifically, the invention concerns a door-lock device provided with a control unit of the above kind, studied and realized in particular to be free from vibrations and electromagnetic fields.

In the following, the description will be in particular directed to the case of installation in a washing machine, but it is clear that the same should not be considered limited to this specific use.

The invention concerns a door-lock device for a door of a household appliance (not shown in the figures), such as a washing machine and the like, provided with a prong or a blocking hook.

Referring to FIGS. 1-6, it is seen a control unit 1 magnetically activated for a door-lock device according to the present invention and, schematically, a mechanical unit M of said door-lock device.

Said mechanical unit M is provided with a movable member S, such as a slider and the like, capable of assuming a release position, in which it allows the opening of said door, and a blocking position, for retaining said door when it is closed.

Said control unit 1 comprises a containment enclosure 20, having a base 21 and a cover 22. Said base has a lateral opening 23 and a lower opening 24, whose function will be better described in the following.

An electromagnet 30, a switching assembly 40, an electrical switches and contacts system 50 and a locking pin 60, adapted to interact with said mechanical unit M, are placed in said containment enclosure 20.

The electromagnet 30 comprises a support structure 31, on which first electrical contacts 51, accessible through the window 23 of said base 21, are arranged. Said electromagnet 30 also includes a solenoid 32, wound on a core made up of a couple of armatures 33, which form an air gap 34.

The electromagnet 30 is supplied via the contacts 51, so as to reverse the polarity of the magnetic field of the air gap 34. On the support structure 31 a safety switch 52 is arranged comprising a fixed electrode 521, electrically connected to one of said electrical contacts 51, and a movable electrode 522, this latter is fixed on a laminated spring 523 (which is a foil).

Said switching assembly 40 comprises two plates 41, arranged parallel to each other, and a permanent magnet 42, interposed between said two plates 41. Plates 41 and permanent magnet are held together by a container 43, made of plastic or, in general, made of amagnetic material, which has laterally a relief 44, whose function will be better defined in the following.

Said switching assembly 40 is pivoted to the containment enclosure 20 along an axis indicated with the letter A, which, in this embodiment, is arranged perpendicularly to the arrangement of the armatures 33. Moreover, said switching assembly 40 has, at one end of the container 43, a seat 45 for a screwdriver, arranged in correspondence of a respective upper opening 25 of said cover 21, when the control unit 1 is mounted.

Locking pin 60 has a first end 61 and a second end 62. At said second end 62 a seat 63 is provided, into which a lamina 533 is inserted, having two ends, on each of which a movable electrode 532 is fixed. In correspondence of each movable electrode 532, a respective fixed electrode 531 is provided, each one fixed to said support structure 31 of said electromagnet 30. Said fixed electrodes 531 are connected to said electrical contacts 51. Lamina 533 and electrodes 531 and 532 form an activation switch 53, which is bridge type double-switch, which allows the closure of the two couples fixed electrode 531 - movable electrode 532 simultaneously.

Said locking pin 60 is movable vertically, parallel to said axis A, so as to assume:

- an extracted position, in which said first end 61 comes out from said lower opening 24 of said containment enclosure 20;
- an intermediate position, in which said first end 61 is within the volume of said containment enclosure 20 and said end 62 does not interact with said lamellar spring 523, keeping closed the safety switch 52, and
- a retracted position, in which said first end 61 is within the volume of said containment enclosure 20 and said end 62 interacts with said lamellar spring 523, keeping open the safety switch 52.

Locking pin 60, when it is in said extended position, is capable to interact with said mechanical unit M of said door-lock, and in particular with an member of the same, i.e. in this case with the slider S, so as to block the opening of the door when said door is in closed position.

Figure 7:
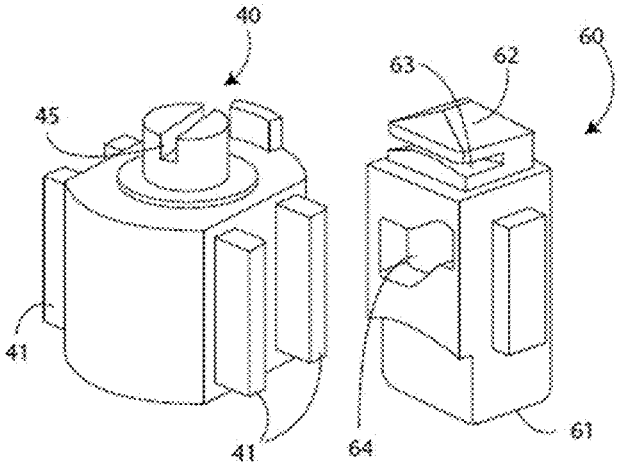
FIG. 7 shows a detail of a locking pin of the control unit according to FIG. 1.
Figure 8:
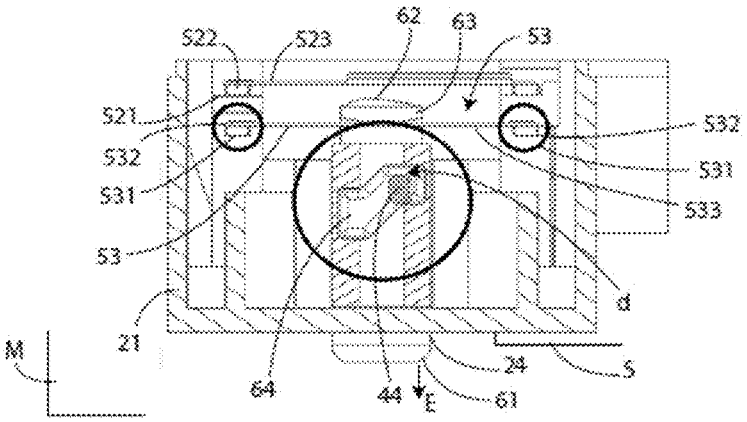
FIG. 8 shows a side sectional view of the control unit of the door-lock device according to the present invention.

Said locking pin 60 has (see FIGS. 7 and 8) laterally a substantially "S"-shaped guide 64, in which relief 44 of said container 43 is slidingly inserted. Said guide 64 has a width greater than said relief 44, so as to create an appropriate clearance d, which function will be better explained in the following.

Figure 9:
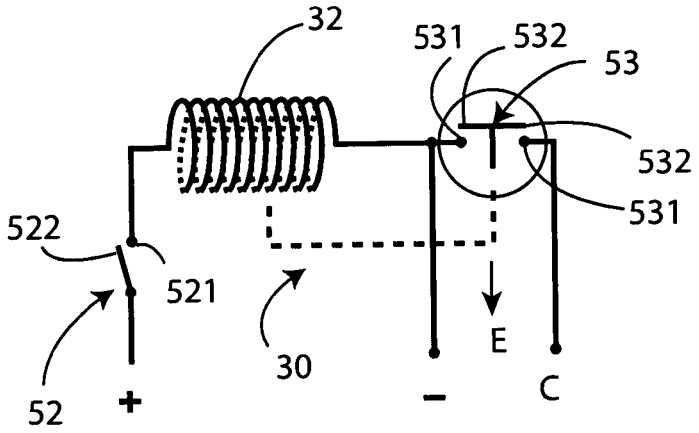
FIG. 9 shows the electrical circuit controlled by the solenoid of the control unit according to FIG. 1.

FIG. 9 shows the electrical circuit of the control unit 1, in which safety switch 52, solenoid 32 and activation switch 53 are connected. Switch 53 is connected in order to allow or not to activate or not the household appliance.

The operation of the door-lock and the control unit 1 described above is as follows.

When the household appliance is switched off and the door is opened, the switching assembly 40 is in an initial configuration or first position and the locking pin 60 is in retracted position. Said locking pin 60 is retained in said retracted position also by said slider S of the mechanical unit M of the door-lock device, preventing said locking pin 60 to pass through said lower opening 24.

In this retracted position, said locking pin 40, with its overall dimensions, raises said lamellar spring 523, keeping the security switch 52 opened.

When the door is closed, the slider S is moved and the locking pin 60 is free to move. In this way, the force exerted by the laminated spring 523 on the lock pin 60 moves vertically the latter, of a path equal to the clearance d, sufficient so that the switch 52 closes. Thus said locking pin 60 passes in said intermediate position, allowing to power supply (see FIG. 9) solenoid 32. Therefore, said switch 52 is adapted to detect the closure of the household appliance door and to enable the operation of the control unit 1 according to the present invention.

Figure 10:
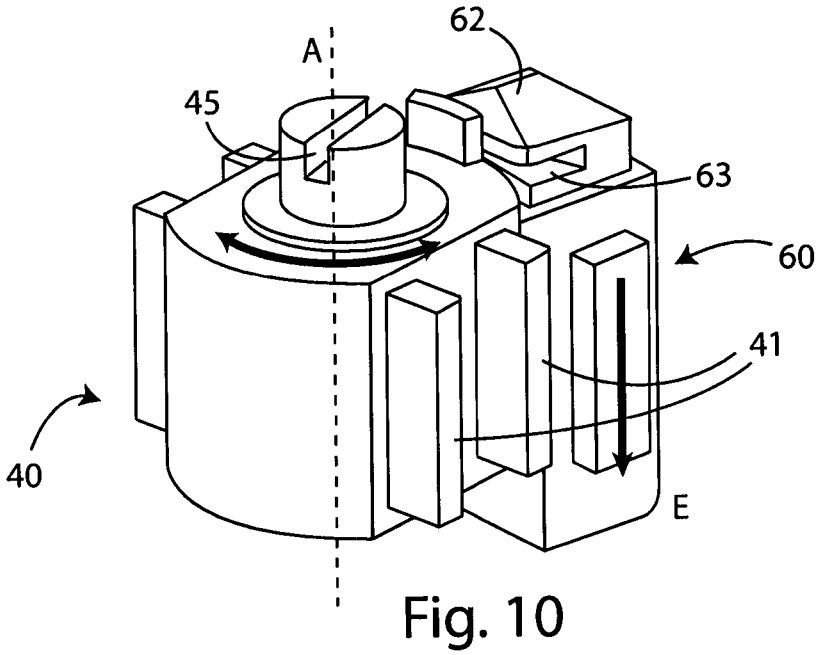
FIG. 10 shows the reciprocal movement of a switching assembly and a locking pin of the control unit for a door-lock device according to the present invention.

When the household appliance is activated, solenoid 32 is powered, so that the magnetic field induced by the power supply of the solenoid 32 changes polarity on the air gap 34, generating an attraction/repulsion with the two plates 41 of the switching assembly 40. Then, as shown in FIG. 10, selector 40 rotates, moving to a second position, and the locking pin 60 moves vertically in the direction of the arrow indicated by letter "E", due to the sliding of the relief 44 of the switching assembly 40 in the guide 64.

The locking pin 60 thus moves to the extracted position, closing the two contacts of the activation switch 53, causing the closure of the circuit shown in FIG. 9 and allowing the activation of the household appliance. Furthermore, when said locking pin 60 moves to the extracted position, said first end 61 comes out from said lower opening 24 of said containment enclosure 20, engaging with the mechanical unit of the door-lock, i.e. with said slider S, inhibiting its movement, and thus preventing also that the door can be opened while the household appliance is operated. Once the switching is carried out, the system will remain in this position due to the magnetic field in the air gap 34, maintained by solenoid 32. To determine a new switching/configuration (opposite rotation of the switching assembly 40) it is sufficient to reverse the polarity of the solenoid driver 32 and give a new control impulse.

In other words, once household appliance operation is completed, the household appliance control logic changes the polarity of the solenoid 32, and therefore that of the magnetic field 30 on the air gap 34, and also the switching assembly 40 rotates, in the opposite direction of the preceding one, from said second to said first position, by passing the locking pin 60 from said extracted position to said intermediate position, always due to the interaction between said relief 44 and said guide 64, so that said activation switch 53.

In case of electrically disabling of the control unit were not possible for any reason, it is possible to do it manually through the rotation of the switching assembly 40 with a generic tool from the outside, such as a screwdriver, by acting on said seat 45.

An advantage of the control unit of the present invention is to provide for a reduced number of components.

A further advantage of the control unit of the present invention is to operate with a low current consumption.

It is also advantage of the present invention to present a low voltage power supply.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A door-lock device for a household appliance, said door-lock device comprising:

a mechanical unit, provided with a movable member capable of assuming a releasing position in which the movable member allows for opening of a door, and a locking position, for retaining said door in a closed position, and a control unit for connection with control logic of said household appliance, the control unit comprising a locking pin capable of assuming at least one position in which the locking pin is disengaged from said movable member, and an extracted position, in which said locking pin is capable of engaging with said movable member when the movable member is in said locking position, said movable member being capable to pass from said locking position to said releasing position when said locking pin is disengaged from said movable member, wherein said control unit further comprises:

an electromagnet having a solenoid that is electrically powered to change a polarity of said solenoid, said electromagnet being provided with an air gap, a switching assembly comprising a magnet, said switching assembly being arranged in said air gap, and being capable of assuming a first and a second position, according to the polarity of a magnetic field in said air gap, generated by said solenoid, said switching assembly comprises a container, laterally provided with a relief, said switching assembly further comprising a container, laterally provided with a relief, and said locking pin has a guide, substantially "S"-shaped, in which said relief of said container is slidingly inserted such that rotation of said switching assembly between its first and second positions causes a translation of said locking pin between the at least one position in which the locking pin is disengaged from the movable member and the extracted position, and an activation switch for controlling a power supply load, wherein said locking pin is kinematically constrained to said switching assembly, such that when said switching assembly is in said first position, said locking pin is disengaged from said movable member of said mechanical unit, and when said switching assembly is in said second position, said locking pin is in said extracted position, causing a closure of said activation switch.

2. The door-lock device according to claim 1, wherein said switching assembly comprises two plates arranged parallel to each other, and the magnet is interposed between said two plates, wherein said plates and said magnet are located in said container.

3. The door-lock device according to claim 1, wherein said control unit comprises a containment enclosure and said switching assembly is pivoted to said containment enclosure.

4. The door-lock device according to claim 1, wherein said activation switch comprises a lamina having two ends, on each of which a movable electrode is fixed, each movable electrode having a respective fixed electrode, and said locking pin has a seat, in which said lamina is inserted.

5. The door-lock device according to claim 1, wherein said control unit comprises a safety switch connected in series with said solenoid, and is arranged so as to remain opened when said door is open.

6. The door-lock device according to claim 5, wherein said safety switch comprises a fixed electrode, a movable electrode, and a lamellar spring on which said movable electrode is arranged, said lamellar spring being arranged in correspondence with said locking pin, and said guide has a width greater than said relief, so as to create play between the relief and the guide, such that when said door is opened, said movable member is in said releasing position and said locking pin assumes a retracted position in which it is retained by said movable member, and in which it maintains open said safety switch in an open position; and when said door is in said closed position, said movable member is in said locking position, in which said locking pin is released towards its extracted position, said locking pin translates a path equal to said play such that said activation switch closes due to a force exerted by said lamellar spring on said locking pin, and said switching assembly switches from said first position to said second position such that said locking pin has reached its extracted position, engaging with said movable member.

7. The door-lock device according to claim 1, wherein said electromagnet comprises a core on which said solenoid is wound, made up of a couple of armatures, which form said air gap.

* * * * *